US006255607B1

(12) United States Patent
Miller

(10) Patent No.: US 6,255,607 B1
(45) Date of Patent: Jul. 3, 2001

(54) SWITCHABLE RECEPTACLE ASSEMBLY HAVING INTERNAL INTERLOCK MECHANISM

(75) Inventor: Michael W. Miller, Burlington, IA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/467,348

(22) Filed: Dec. 20, 1999

(51) Int. Cl.[7] ..... H01H 9/20
(52) U.S. Cl. ..... 200/50.29
(58) Field of Search ..... 200/50.27–50.31, 200/51 R–51.17

(56) References Cited

U.S. PATENT DOCUMENTS

| | | | | |
|---|---|---|---|---|
| 1,818,290 | * | 8/1931 | Wulle | 200/50.3 |
| 2,397,595 | * | 4/1946 | Conlan | 200/50.3 |
| 2,470,944 | * | 5/1949 | Parish | 200/50.29 |
| 3,195,095 | | 7/1965 | Field | 339/16 |
| 3,735,078 | * | 5/1973 | Appleton et al. | 200/50.3 |
| 4,503,293 | * | 3/1985 | Knecht | 200/50.3 |
| 4,553,000 | * | 11/1985 | Appleton | 200/50.29 |
| 5,298,703 | * | 3/1994 | Sandor | 200/50.31 |
| 5,573,412 | | 11/1996 | Anthony | 439/133 |
| 5,588,853 | | 12/1996 | Anthony | 439/136 |
| 5,680,926 | * | 10/1997 | Sandor et al. | 200/51.08 |
| 5,880,420 | * | 3/1999 | Rohmer et al. | 200/50.28 |

* cited by examiner

*Primary Examiner*—J. R. Scott
(74) *Attorney, Agent, or Firm*—Michael R. Swartz

(57) ABSTRACT

A receptacle assembly includes a housing having an interior chamber, a switch mechanism movably mounted to the housing and having a portion extending into the interior chamber with the switch mechanism capable of being moved relative to the housing and switched between OFF and ON positions, a receptacle body spaced from the switch mechanism and mounted to the housing with receptacle body having an interior cavity in which a plug can be inserted into the receptacle body, and an internal interlock mechanism supported within the interior chamber of the housing and extending between the interior cavity of the receptacle body and the portion of the switch mechanism extending into the interior chamber of the housing. The interlock mechanism is rotatable between unlocked and locked positions relative to the receptacle body and relative to the portion of the switch mechanism such that the interlock mechanism when in the locked position relative to the receptacle body and concurrently in the unlocked position relative to the switch mechanism prevents removal of a plug from the receptacle body after the switch mechanism has been switched to the ON position, whereas the interlock mechanism when in the unlocked position relative to the receptacle body and concurrently in the locked position relative to the switch mechanism prevents switching of the switch mechanism from the OFF position to the ON position once a plug is allowed to be removed from or reinserted into the receptacle body.

18 Claims, 9 Drawing Sheets

SWITCHABLE RECEPTACLE ASSEMBLY HAVING INTERNAL INTERLOCK MECHANISM

BACKGROUND OF THE INVENTION

1. Field of the Invention

The present invention generally relates to plug and receptacle assemblies designed for heavy duty industrial uses and, more particularly, is concerned with a switchable receptacle assembly having an internal interlock mechanism.

2. Description of the Prior Art

Devices, such as plugs and receptacle assemblies, designed for heavy duty industrial uses have been manufactured and marketed for some time by Killark Electric Manufacturing Company, a subsidiary of Hubbell Incorporated, the assignee of the present invention, and by other companies as well. These devices supply electrical power to both fixed and portable electrical equipment including pumps, generators, welders, vacuums, blowers and similar apparatus. These devices are suitable for indoor or outdoor environments and wet, cold, hosedown and corrosive locations commonly encountered in chemical, petrochemical, refining, pharmaceutical, food processing offshore energy, coal mining and many other industries.

Many of these devices have interlock mechanisms to prevent inadvertent removal of plugs from the receptacle assemblies. The interlock mechanism has typically been mounted on the exterior of the receptacle assembly in order to engage an external recess provided in the plug to prevent its removal. A problem which arises with providing the interlock mechanism on the exterior of the receptacle assembly is that this typically has eliminated the use of external threads on the receptacle assembly for reason that external threads would block any radial engagement of the external recess by the interlock mechanism, especially when other supporting structure is considered. The provision of external threads are desired to enable meeting certain industrial rating standards for weather resistance.

Consequently, a need exists for an innovation which will provide a suitable interlock function without sacrificing the provision of external threads on the receptacle assembly.

SUMMARY OF THE INVENTION

The present invention provides a receptacle assembly designed to satisfy the aforementioned need. Whereas the approach of the prior art has been to locate the interlock mechanism external to the receptacle assembly, the approach of the present invention is to locate an interlock mechanism internal to the receptacle assembly which accomplishes all interlock functionality without disturbing the provision of external threads on the receptacle assembly. The internal interlock mechanism prevents removal of the plug from the receptacle body after the switch mechanism has been switched to the ON position and prevents switching of the switch mechanism from the OFF position to the ON position once the interlock mechanism has been unlocked relative to the receptacle body allowing removal of the plug from or insertion of the plug into the receptacle body.

Accordingly, the present invention is directed to a receptacle assembly which comprises: (a) a housing having an interior chamber; (b) a switch mechanism movably mounted to the housing and having a portion extending into the interior chamber, the switch mechanism capable of being moved relative to the housing and switched between OFF and ON positions; (c) a receptacle body spaced from the switch mechanism and mounted to the housing, the receptacle body having an interior cavity in which a plug can be inserted into the receptacle body; and (d) an internal interlock mechanism supported within the interior chamber of the housing and extending between the interior cavity of the receptacle body and the portion of the switch mechanism extending into the interior chamber of the housing. The interlock mechanism is rotatable between unlocked and locked positions relative to the receptacle body and relative to the portion of the switch mechanism such that the interlock mechanism, when in the locked position relative to the receptacle body and concurrently in the unlocked position relative to the switch mechanism, prevents removal of a plug from the receptacle body after the switch mechanism has been switched to the ON position whereas the interlock mechanism, when in the unlocked position relative to the receptacle body and concurrently in the locked position relative to the switch mechanism, prevents switching of the switch mechanism from the OFF position to the ON position once a plug is allowed to be removed from or reinserted into the receptacle body.

More particularly, the interlock mechanism includes elongated interlock shaft having first and second end portions and an intermediate portion disposed between the first and second end portions. The interlock shaft is rotatably supported within the interior chamber of the housing and extends at the first end portion to adjacent to an inner portion of a switch shaft of the switch mechanism and extends at the second end portion into the interior cavity of the receptacle body. The second end portion of the interlock shaft has a pawl thereon protruding laterally therefrom such that rotation of the interlock shaft moves the pawl between withdrawn and locking positions relative to a plug inserted in the interior cavity of the receptacle body.

Also, the interlock mechanism includes a catch element disposed adjacent to the second end portion of the interlock shaft and coupled therewith when the plug is removed from the receptacle body such that the interlock shaft is held by the catch element in the unlocked position relative to the receptacle body and concurrently in the locked position relative to the switch mechanism. The catch element is displaced relative to the second end portion of the interlock shaft and decoupled therefrom when the plug is inserted into the receptacle body such that the interlock shaft is released by the catch element and free to move between the unlocked and locked positions relative to the receptacle body and the switch mechanism.

Further, the interlock mechanism includes means for interfacing the first end portion of the interlock shaft and the inner portion of the switch shaft with each other such that rotation of the switch shaft to the OFF and ON positions of the switch mechanism correspondingly allows and prevents rotation of the interlock shaft whereas rotation of the interlock shaft to the unlocked and locked positions relative to the receptacle body and of the pawl to the withdrawn and locking positions relative to a plug in the receptacle body correspondingly prevents rotation of the switch shaft from the OFF position of the switch mechanism and allows rotation of the switch shaft between the OFF and ON positions of the switch mechanism.

Still further, the interlock mechanism includes an actuator assembly having an actuating shaft with outer and inner end portions and being mounted to the housing for undergoing reciprocal movement in the interior chamber thereof toward and away from the intermediate portion of the interlock shaft and an actuating button attached on the outer end portion of the actuating shaft and disposed exteriorly of the housing for depressing and releasing the actuating button to move the actuating shaft relative to the intermediate portion of the interlock shaft. The interlock mechanism also includes means for movably coupling the intermediate portion of the interlock shaft to the lower end portion of the actuating shaft such that depression and release of the actuating button and shaft correspondingly causes rotation of the interlock shaft in opposite directions and vice versa. The actuating button and shaft are held at a disabled position and prevented from being depressed when the interlock shaft is in the locked position relative to the receptacle body and the switch mechanism is in the ON position. The actuating button and shaft are released from the disabled position and allowed to be actuated, that is, depressed and reciprocally moved, to rotate the interlock shaft from the locked position to the unlocked position relative to the receptacle body when the switch mechanism is in the OFF position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
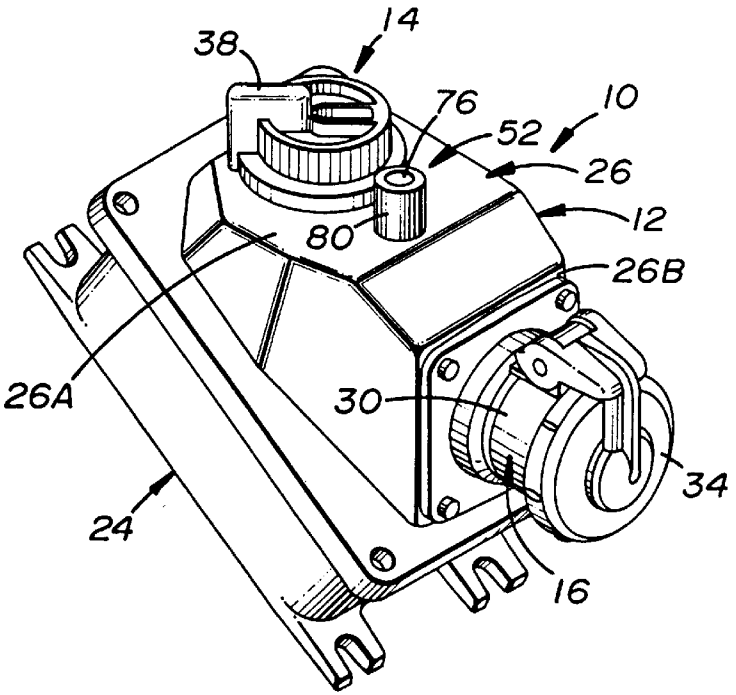
FIG. 1 is a perspective view of a switchable receptacle assembly of the present invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Figure 5:
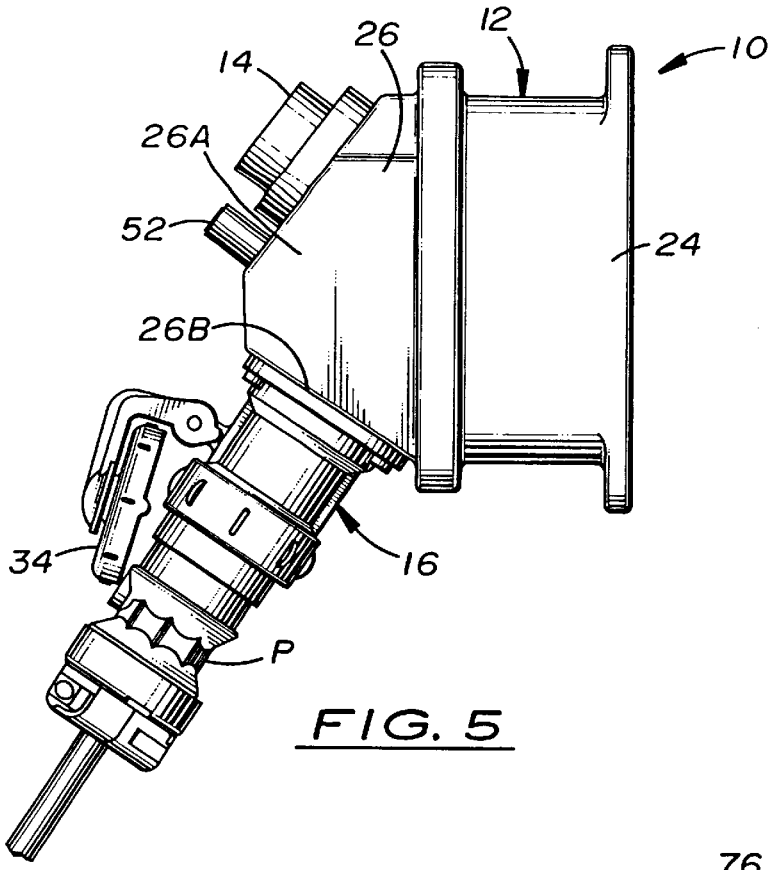
FIG. 5 is a side elevational view of the assembly having a plug inserted into the receptacle body of the assembly.
Figure 6:
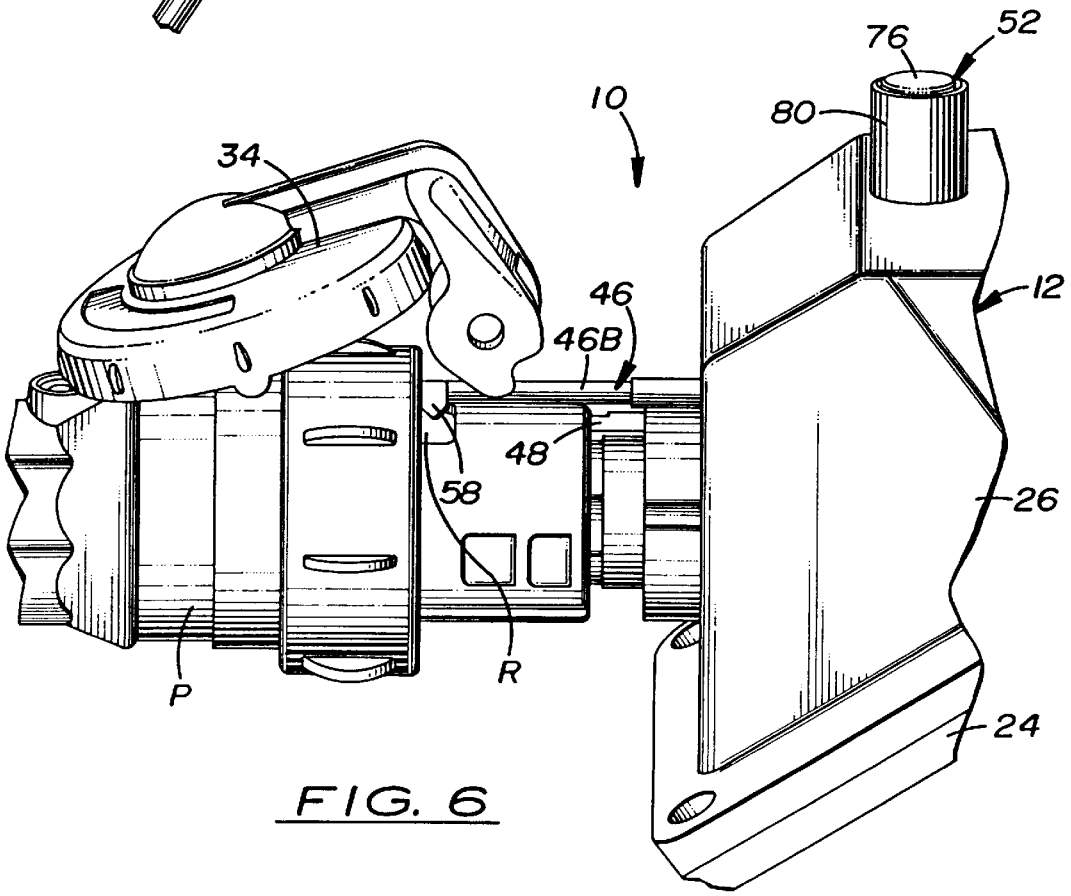
FIG. 6 is an enlarged fragmentary perspective view of the assembly and plug of FIG. 5 with the receptacle body being omitted to show an interlock shaft and catch element of the internal interlock mechanism of the assembly.
Figure 7:
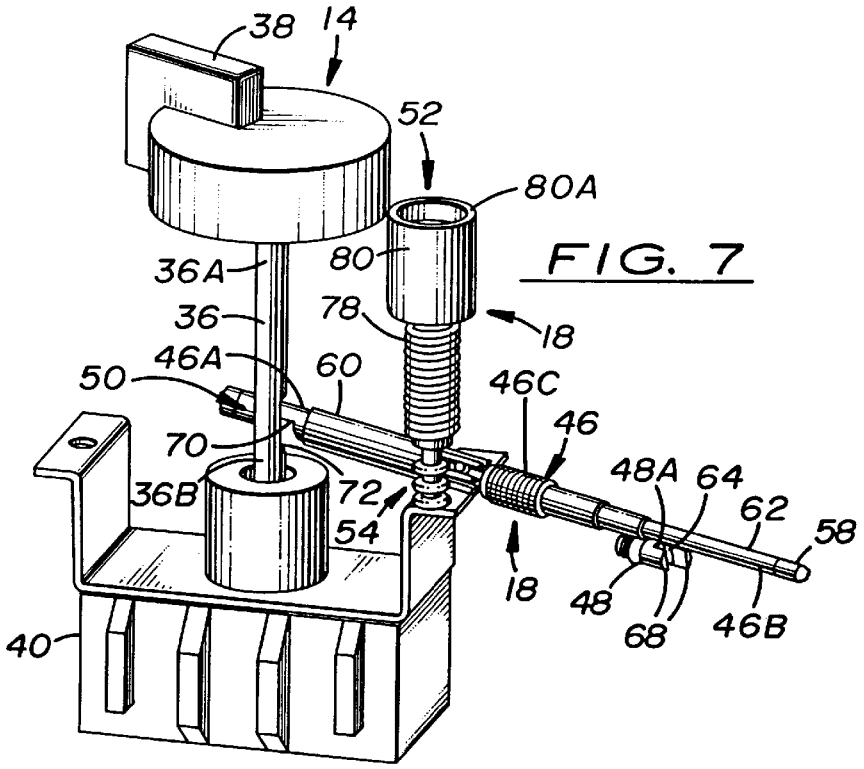
FIG. 7 is an enlarged partial perspective view of the assembly showing the switch mechanism of the assembly and the interlock shaft, catch element and an actuating button and shaft of the interlock mechanism of the assembly with the switch mechanism in an OFF position and the interlock mechanism in a locked position relative to the switch mechanism and in an unlocked position relative to the receptacle body of the assembly.
Figure 8:
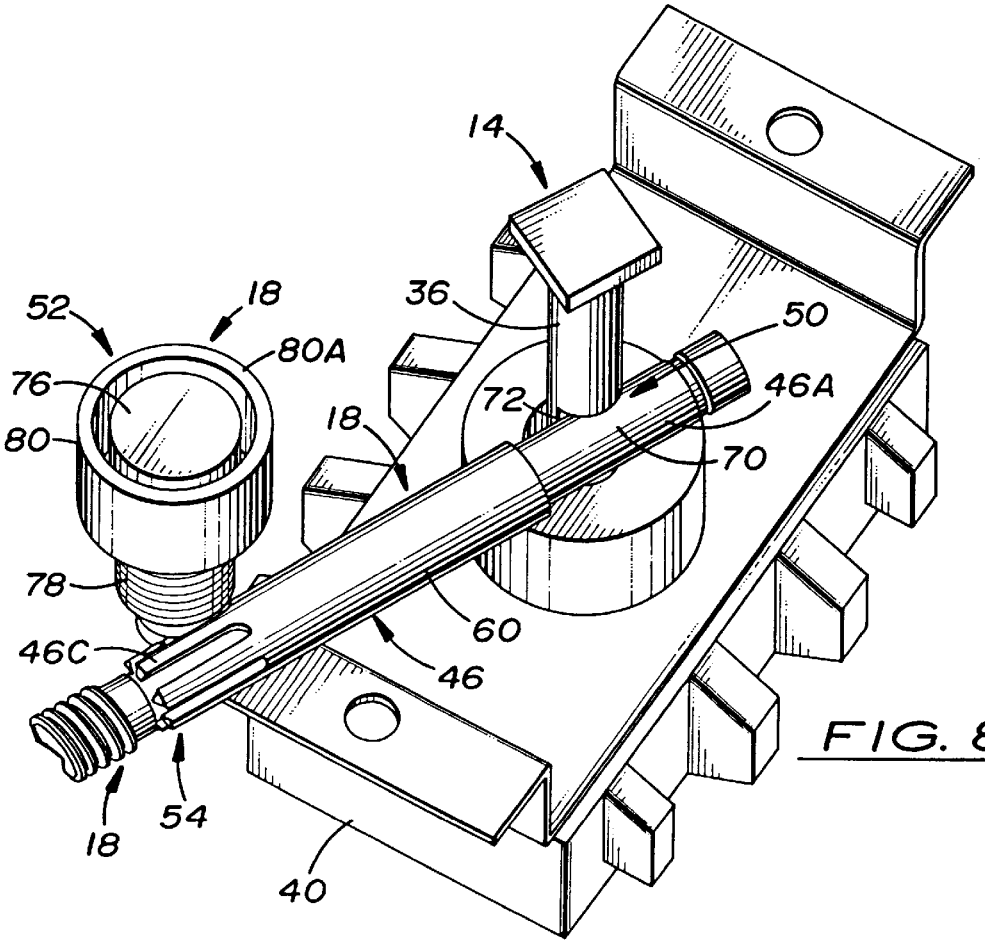
FIG. 8 is another enlarged fragmentary perspective view of the assembly showing the switch mechanism and internal interlock mechanism of the assembly with the switch and interlock mechanisms in the same positions as seen in FIG. 7.
Figure 9:
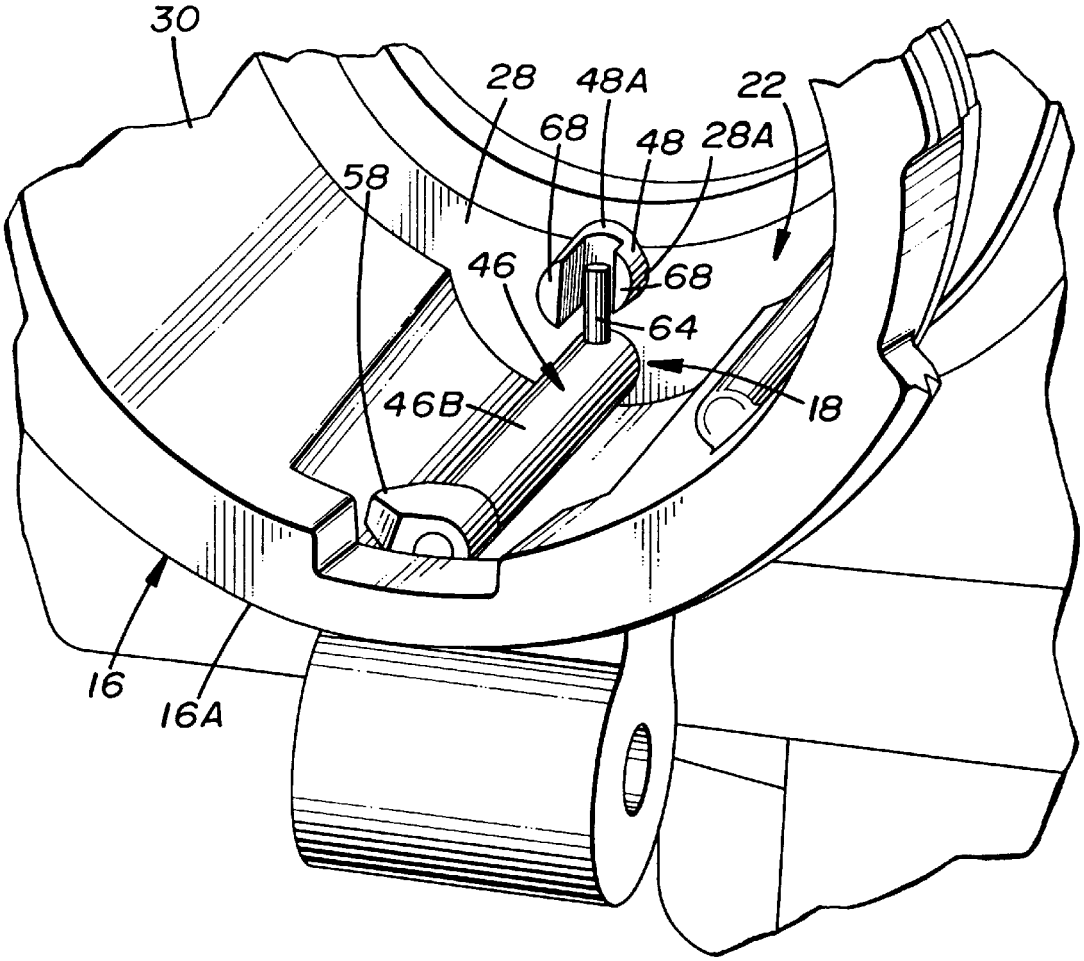
FIG. 9 is an enlarged fragmentary perspective view of the assembly showing the receptacle body of the assembly and the interlock shaft and catch element of the internal interlock mechanism of the assembly with the interlock mechanism in the same position as seen in FIG. 7.
Figure 10:
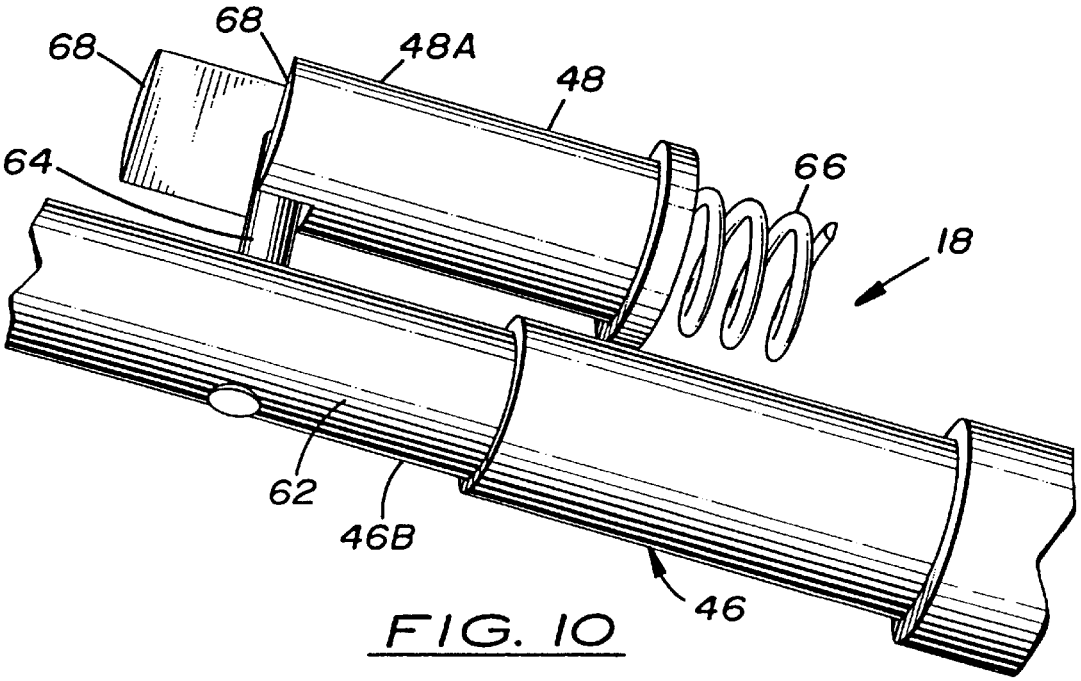
FIG. 10 is another enlarged fragmentary perspective view of the assembly showing the interlock shaft and catch element of the internal interlock mechanism of the assembly with the interlock mechanism in the same position as seen in FIG. 7.
Figure 14:
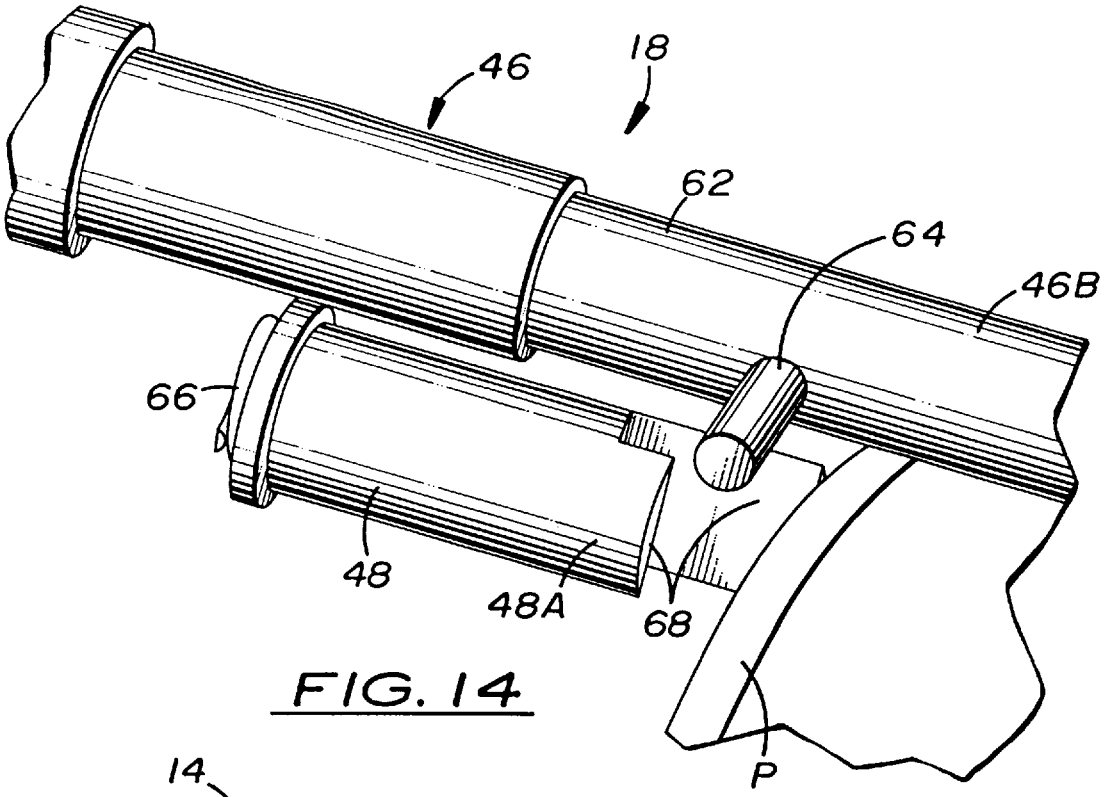
FIG. 14 is another enlarged fragmentary perspective view of assembly showing the interlock shaft and catch element of the internal interlock mechanism of the assembly with the interlock mechanism in the same position as seen in FIG. 11.
Figure 11:
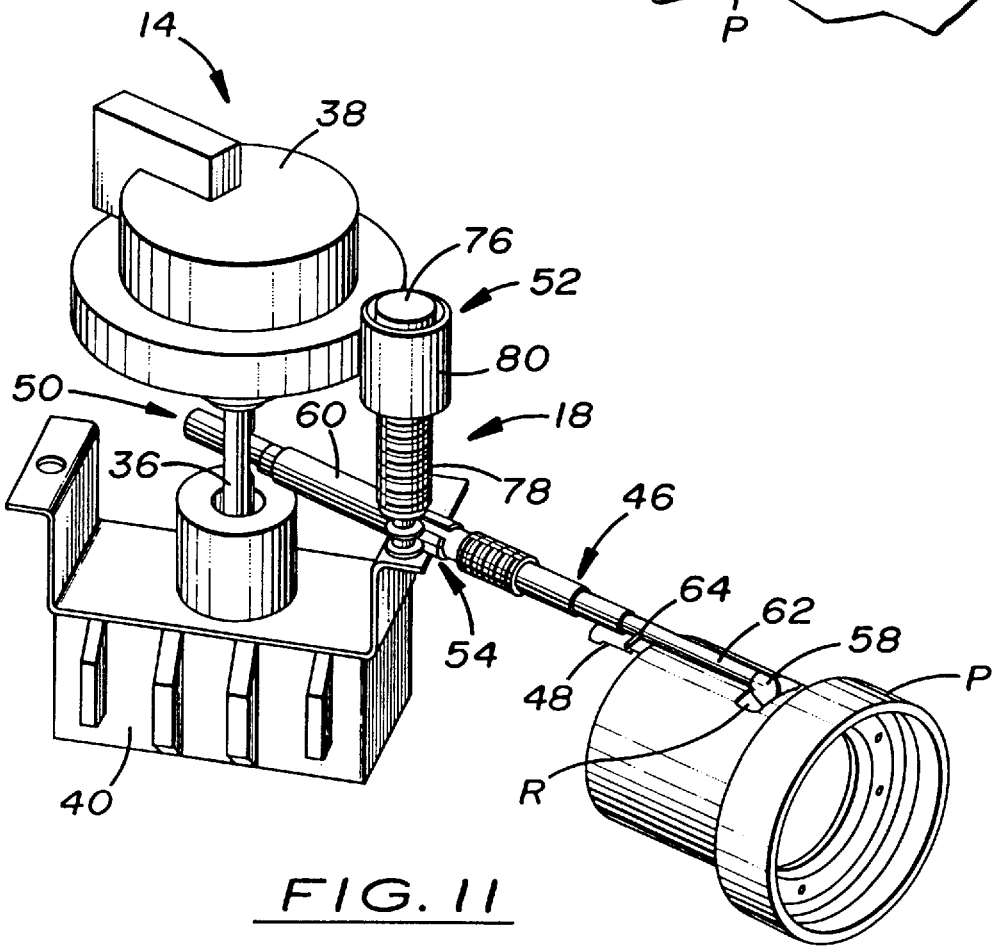
FIG. 11 is an enlarged partial perspective view of the assembly showing the receptacle body and switch mechanism of the assembly and the interlock shaft, catch element and actuating button and shaft of the interlock mechanism of the assembly with the switch mechanism in an OFF position and the interlock mechanism in an unlocked position relative to the switch mechanism and in a locked position relative to the receptacle body of the assembly.
Figure 12:
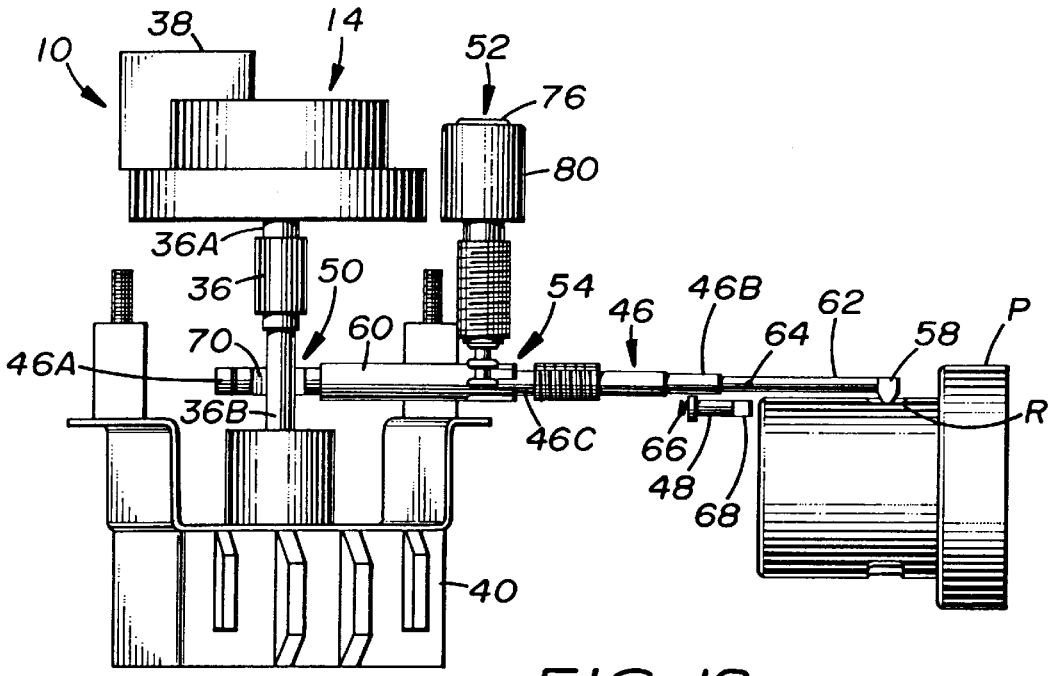
FIG. 12 is a side elevational view of the assembly showing the receptacle body, switch mechanism and interlock mechanism of the assembly with the switch and interlock mechanisms in the same positions as seen in FIG. 11.
Figure 13:
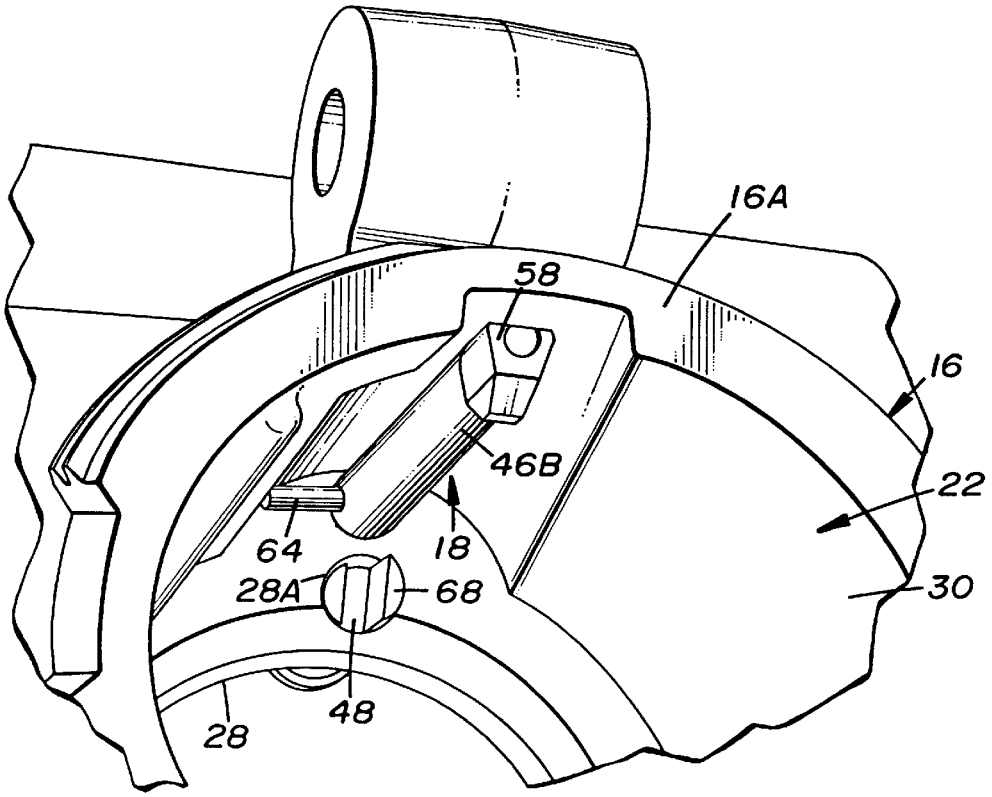
FIG. 13 is an enlarged fragmentary perspective view of the assembly showing the receptacle body of the assembly and the interlock shaft and catch element of the internal interlock mechanism of the assembly with the interlock mechanism in the same position as seen in FIG. 11.
Figure 15:
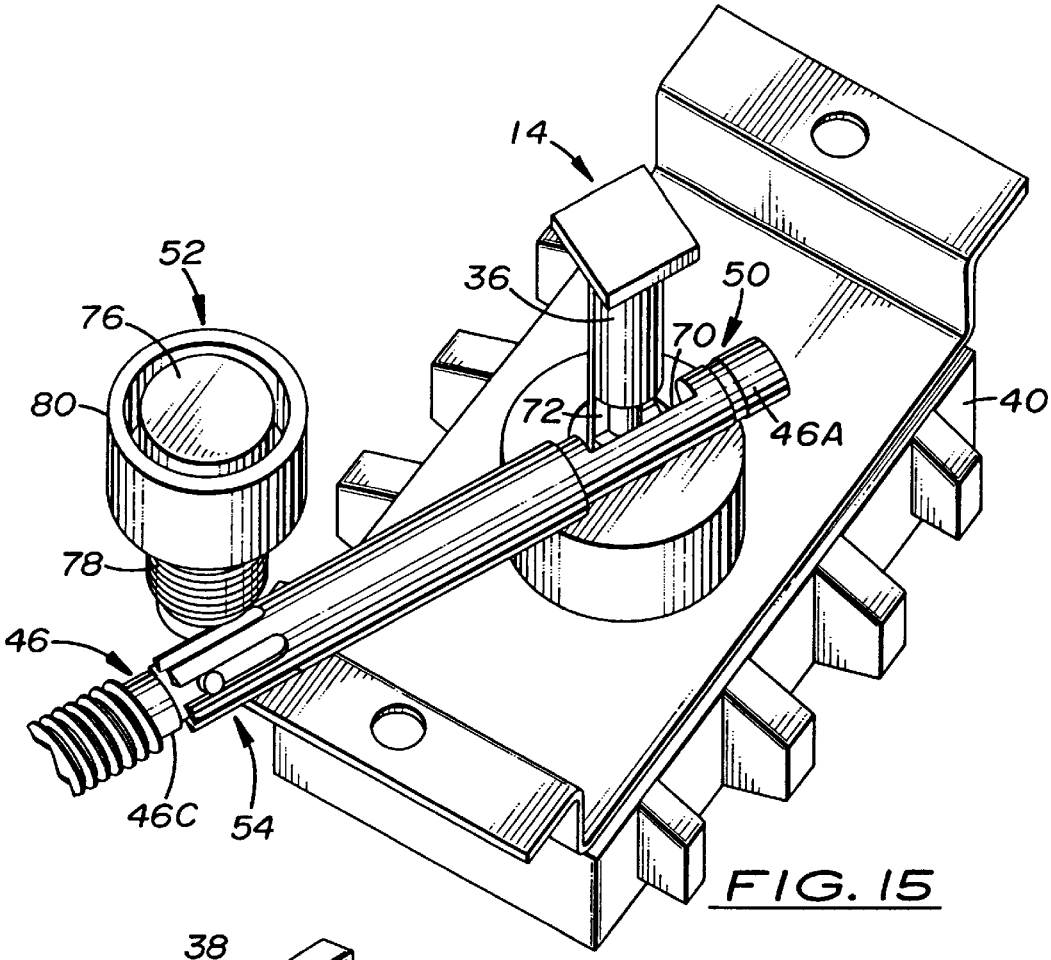
FIG. 15 is an enlarged fragmentary perspective view of the assembly showing the switch mechanism of the assembly and the interlock shaft and actuating button and shaft of the interlock mechanism of the assembly with the switch mechanism in an OFF position and the interlock mechanism in an unlocked position relative to the switch mechanism and in a locked position relative to the receptacle body of the assembly.

Referring to the drawings and particularly to FIG. 1–14, there is illustrated a switchable receptacle assembly of the present invention, generally designated 10, for receiving a prior art plug P, such as seen in FIGS. 5 and 6. The receptacle assembly 10 basically including a housing 12, a switch mechanism 14, a receptacle body 16, and an internal interlock mechanism, generally designated 18. The housing 12 has an interior chamber 20. The switch mechanism 14 is movably mounted to the housing 12 and has a portion 14A extending into the interior chamber 20 of the housing 12. The switch mechanism 14 can be moved relative to the housing 12 and switched between OFF and ON positions. The receptacle body 16 is mounted to the housing 12 in a spaced relationship from the switch mechanism 14. The receptacle body 16 has an interior cavity 22 in which a plug P can be inserted into the receptacle body 16 as seen in FIGS. 5 and 6. The internal interlock mechanism 18 is supported within the interior chamber 20 of the housing 12 and extends between the interior cavity 22 of the receptacle body 16 and the portion 14A of the switch mechanism 14 extending into the interior chamber 20 of the housing 12. The interlock mechanism 18 is rotatable between unlocked and locked positions relative to the receptacle body 16 and relative to the portion 14A of the switch mechanism 14 such that the interlock mechanism 18 when in locked position relative to the receptacle body 16 and concurrently in unlocked position relative to the switch mechanism 14 prevents removal of a plug P from the receptacle body 16 after the switch mechanism 14 has been switched to the ON position, whereas the interlock mechanism 18 when in unlocked position relative to the receptacle body 16 and concurrently in locked position relative to the switch mechanism 14 prevents switching of the switch mechanism 14 from the OFF to ON position once a plug P is allowed to be removed from or inserted into the receptacle body 16.

The housing 12 of the receptacle assembly 10 further includes a backbox 24 and a cover 26 attached on the backbox 24 such that the backbox 24 and cover 26 form the interior chamber 20 of the housing 12. The cover 26 has first and second mounting portions 26A, 26B angularly displaced from one another. The switch mechanism 14 is mounted to the first mounting portion 26A of the cover 26 of the housing 12. The receptacle body 16 is mounted to the second mounting portion 26B of the cover 26 of the housing 12.

The receptacle body 16 includes an annular bottom portion 28 and an annular sidewall portion 30 attached to, surrounding and extending outwardly from the bottom portion 28 and defining the interior cavity 22 of the receptacle body 16. An interior contact assembly 32 is disposed in the receptacle body 16 and extending through and supported by the annular bottom portion 28 and spaced inwardly from the annular sidewall portion 30 of the receptacle body 16. The interior contact assembly 32 is adapted to receive thereover a complementary female socket of the plug P when the plug is inserted into the receptacle body 16. The receptacle body 16 also has a hinged cover 34 which is closed over an open end 16A of the receptacle body 16 when the plug P is removed. The plug P when inserted into the interior cavity 22 of the receptacle body 16 extends to the annular bottom portion 28 thereof.

The switch mechanism 14 of the assembly 10 basically includes a switch shaft 36, a knob 38 and a rotary switch module 40. The switch shaft 36 has opposite outer and inner portions 36A, 36B and is rotatably mounted, via a sealed cover 42 and a bushing 44, to the first mounting portion 26A of the cover 26 of the housing 12. The inner portion 36B of the switch shaft 36 is on the portion 14A of the switch that extends into the interior chamber 20 of the housing 12. The knob 38 is disposed exteriorly of the cover 26 of the housing 12 and attached on the outer portion 36A of the switch shaft 36 for gripping by a person in order to rotate the switch shaft 36 and thereby move the switch mechanism 14 between its OFF and ON positions. The rotary switch module 40 is supported from the inside of the cover 26 of the housing 12 and is coupled to the inner end 36C of the switch shaft 36 and is rotated between the OFF and ON positions of the switch mechanism 14 by turning of the knob 38 and rotation of the switch shaft 36. The rotary switch module 40 is electrically connected in a known manner by conductor wires (not shown) to the interior contact assembly 32 in the receptacle body 16.

Referring to FIGS. 3, 4 and 6–18, the internal interlock mechanism 18 of the assembly 10 basically includes an elongated interlock shaft 46, a catch element 48, means 50 for interfacing the switch shaft 36 with the interlock shaft 46, an actuator assembly 52, and means 54 for movably coupling the actuator assembly 52 with the interlock shaft 46. The interlock shaft 46 of the interlock mechanism 18 has first and second end portions 46A, 46B and an intermediate portion 46C disposed between said first and second end portions 46A, 46B. The interlock shaft 46 is rotatably mounted at the first end portion 46A thereof within the interior chamber 20 of the housing 12 to a block 56 which is supported by the switch mechanism 14. The first end portion 46A of the interlock shaft 46 extends adjacent to the inner portion 36B of the switch shaft 36. The interlock shaft 46 also is rotatably mounted at the second end portion 46B thereof to the annular bottom portion 28 of the receptacle body 16 and extends therethrough and into the interior cavity 22 of the receptacle body 16 along the annular sidewall 30 thereof. The second end portion 46B of the interlock shaft 46 has a pawl 58 attached thereon which protrudes laterally therefrom such that rotation of the interlock shaft 46 pivots the pawl 58 between withdrawn and locking positions in which the pawl 58 respectively is displaced from and protrudes into an external recess R in the plug P when the latter is inserted in the interior cavity 22 of the receptacle body 16. In the exemplary embodiment illustrated in FIG. 4, the interlock shaft 46 includes an interface shaft segment 60 and a locking shaft segment 62 disposed in axial alignment and connected end-to-end with one another such that the interface and locking shaft segments 60, 62 rotate together. The interface shaft segment 60 is disposed entirely in the interior chamber 20 of the housing and defines the first end portion 46A of the interlock shaft 46 disposed adjacent to the inner portion 36B of the switch shaft 36. The locking shaft segment 62 is disposed substantially in the interior cavity 22 of the receptacle body 16 and defines the second end portion 46B of the interlock shaft 46 and has the pawl 58 thereon.

The catch element 48 of the interlock mechanism 18 is slidably mounted to the annular bottom portion 28 of the receptacle body 16 and disposed adjacent to the second end portion 46B of the interlock shaft 46. The interlock mechanism 18 also includes a pin 64 attached to and protruding transversely from the second end portion 48B of the interlock shaft 46 and a compression spring 66 captured between the catch element 48 and the bottom portion 28 of the receptacle body 16 such that the catch element 48 is biased to extend from the bottom portion 46A and into the interior cavity 22 of the receptacle body 16 toward the pin 64 in the absence of a plug P in the interior cavity 22. The catch element 48 has a pair of spaced tangs 68 on the outer end 48A of the catch element 48 which straddle the pin 64 and thereby prevent the pin 64 from pivoting and the interlock shaft 46 from rotating. When the plug P is removed from the interior cavity 22 of the receptacle body 16, the interlock shaft 46 is held by the catch element 48 in the unlocked position relative to the receptacle body 16, that is, the pawl 58 is displaced to its withdrawn position from the external recess R in the plug P but concurrently the interlock shaft 46 is also held in the locked position relative to the switch mechanism 14. The catch element 48 is displaced into the bottom portion 28 of the receptacle body 16 against the spring 66 and relative to the second end portion 46B of the interlock shaft 46 and decoupled from the pin 64 when a plug P is inserted into the interior cavity 22 of the receptacle body 16. When the catch element 48 is decoupled from the pin 64, the interlock shaft 46 is released by the catch element 48 and free to move between the unlocked and locked positions relative to the receptacle body 36 and switch mechanism 14.

The interfacing means 50 interfaces the first end portion 46A of the interlock shaft 46 with the inner portion 36B of the switch shaft 36 such that rotation of the switch shaft 36 to the OFF and ON positions of the switch mechanism 14 correspondingly allows and prevents rotation of the interlock shaft 46 whereas rotation of the interlock shaft 46 to the unlocked and locked positions relative to the receptacle body 16 and of the pawl 58 to the withdrawn and locking positions relative to a plug P correspondingly prevents rotation of the switch shaft 36 from the OFF position of the switch mechanism 14 and allows rotation of the switch shaft 36 between the OFF and ON positions of the switch mechanism 14. The interfacing means 50 includes one cutout or recessed section 70 defined in the first end portion 46A of the interlock shaft 46 and a complementary cutout or recessed section 72 defined in the inner portion 36B of the switch shaft 36. The recessed sections 70, 72 are arranged relative to one another such that contact will occur between the switch shaft 36 and the interlock shaft 46 when the switch shaft 36 is in the ON position of the switch mechanism 14, but will not occur between the switch shaft 36 and interlock shaft 46 when the switch shaft 36 is in the OFF position, that will prevent rotation of the interlock shaft 46 from the locked position to the unlocked position relative to the receptacle body 16.

The actuator assembly 52 includes an actuating shaft 74, an actuating button 76 and a biasing spring 78. The actuating shaft 74 has outer and inner end portions 74A, 74B and is mounted to the first mounting portion 26A of the cover 26 of the housing 12 for undergoing reciprocal movement in the interior chamber 20 toward and away from the intermediate portion 46C of the interlock shaft 46. The actuating button 76 is attached on the outer end portion 74A of the actuating shaft 74 and disposed exteriorly of the housing 12 for a person to access in order to depress and release the button 76 to move the actuating shaft 74 relative to the interlock shaft 46.

The movably coupling means 54 couples the intermediate portion 46C of the interlock shaft 46 with the lower end portion 74B of the actuating shaft 74 such that the depressing and release of the actuating button 76 and actuating shaft 74 correspondingly cause rotation of the interlock shaft 46 in opposite directions. The actuating button 76 and actuating shaft 74 are held at a disabled position, depressed within a bushing 80 surrounding the button 76, when the interlock shaft 46 is at the locked position and the switch mechanism 14 is at the ON position. The actuating button 76 and actuating shaft 74 are released from the disabled position and allowed to be depressed when the interlock shaft 46 is at the unlocked position and the switch mechanism 14 is at the OFF position. In an exemplary embodiment, the movable coupling means 54 is a rack-and-pinion arrangement on the interlock shaft 46 and the actuating shaft 74.

The operation of the internal interlock mechanism 18 can be broken down into the following four conditions: (1) no plug—switch locked off—actuating button disabled; (2) plug inserted and locked—switch off but free to actuate; (3) plug inserted and locked—switch on—actuating button disabled; and (4) plug inserted and released—switch off—actuating button depressed. The interlock mechanism 18 includes key features that accomplish the required logic of the interlocked receptacle assembly 10. These features will be described in detail hereafter as the operation of the interlocked receptacle assembly 10 is further explained.

Referring to FIGS. 7–10, under the first condition (no plug—switch locked off—release button disabled), without an installed plug P, the switch mechanism 14 must be locked in the OFF position to eliminate an arcing risk should someone try to energize a live load from the receptacle body 16. This safety feature is provided by the interaction of the recessed section 70 on the first end portion 46A of the interlock shaft 46 with the recessed section 72 on the inner portion 36B of the switch shaft 36. When the plug-retaining pawl 58 on the interlock shaft 46 is rotated therewith to the withdrawn position to allow entry of a plug P into the receptacle body 14, the recessed section 70 on the interlock shaft 46 is located so as to intrude into the recessed section 72 on the switch shaft 36 and thereby prevents rotation of the switch shaft 36. In this first condition, the withdrawn pawl 58 on the interlock shaft 46 is located outside the perimeter of the volume that would be occupied by a plug P in the receptacle body 16 and therefore does not hinder removal or insertion of the plug P. However, the switch shaft 36 is prevented by the interlock shaft 46 from being rotated to the ON position shown in FIG. 2. At the bottom portion 28 of the receptacle body 16 in the interior cavity 22 the catch element 48, due to the absence of a plug P therein, has been pushed upward by the compression catch spring 66 beneath it. The tangs 68 atop the catch element 48 straddle the pin 64 protruding transversely from the interlock shaft 46 and prevent the interlock shaft 46 from rotating.

Referring to FIGS. 11–15, in the second condition (plug inserted and locked switch off but free to actuate), when a plug P is installed in the interior cavity 22 of the receptacle body 16, it depresses the catch element 48, disengages the pin 64 of the interlock shaft 46 from between both tangs 68 on the catch element 48 and allows the interlock shaft 46 to be rotated. The biasing spring 78 located about the actuating shaft 74 of the actuator assembly 52 and under the actuating button 76 thereof on the outer portion 74A of the actuating shaft 74 is biased to move the actuating shaft 74 and the actuating button 76 therewith upwardly beyond an upper open end 80A of the bushing 80 such that the actuating button 76 is exposed. Through the rack-and-pinion coupling joint 54 between the inner portion 74B of the actuating shaft 74 and the intermediate portion 46C of the interlock shaft 46, the upward movement of the actuating shaft 74 rotates the interlock shaft 46 into the locked position and therewith the pawl 58 into the locking position. In the locking position, the pawl 58 rotates into the recess R in the plug P and prevents removal of the plug P. The rotation of the interlock shaft 46 also rotates its recessed section 70 at the first end portion 46A thereof into alignment with the recessed section 72 of the switch shaft 36 such that none of the interlock shaft 46 intrudes into the recessed section 72 of the switch shaft 36. The switch knob 38 and shaft 36 can now be rotated freely between the OFF and ON positions shown in FIG. 2.

Figure 2:
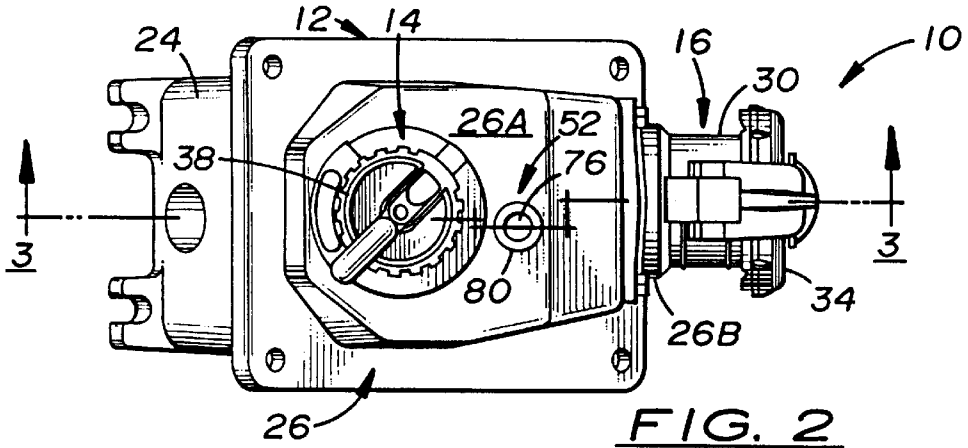
FIG. 2 is a top plan view of the assembly of FIG. 1.
Figure 3:
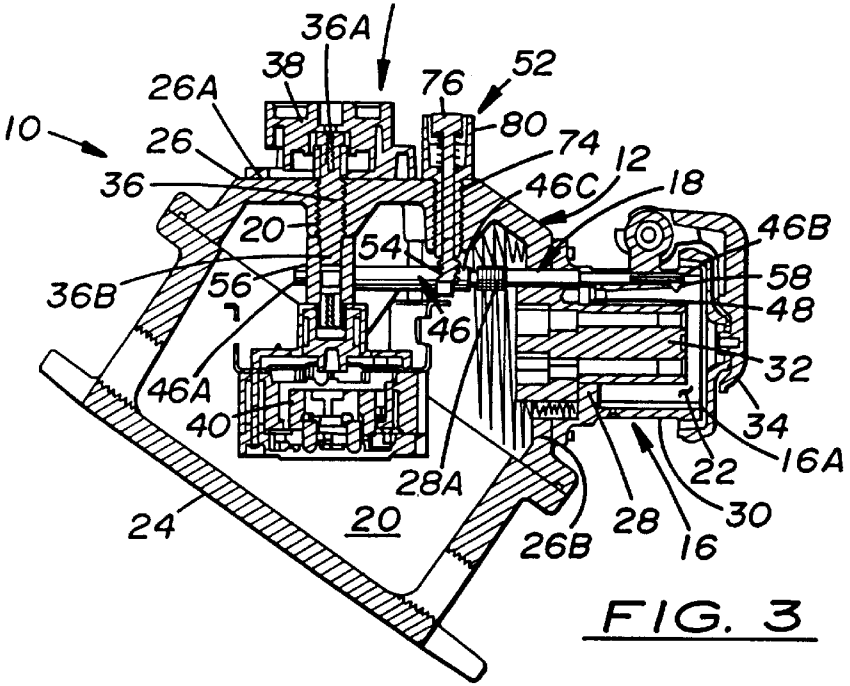
FIG. 3 is a longitudinal sectional view of the assembly taken along line 3—3 of FIG. 2 showing an internal interlock mechanism which extends between and interfaces with a switch mechanism and a receptacle body of the assembly.
Figure 4:
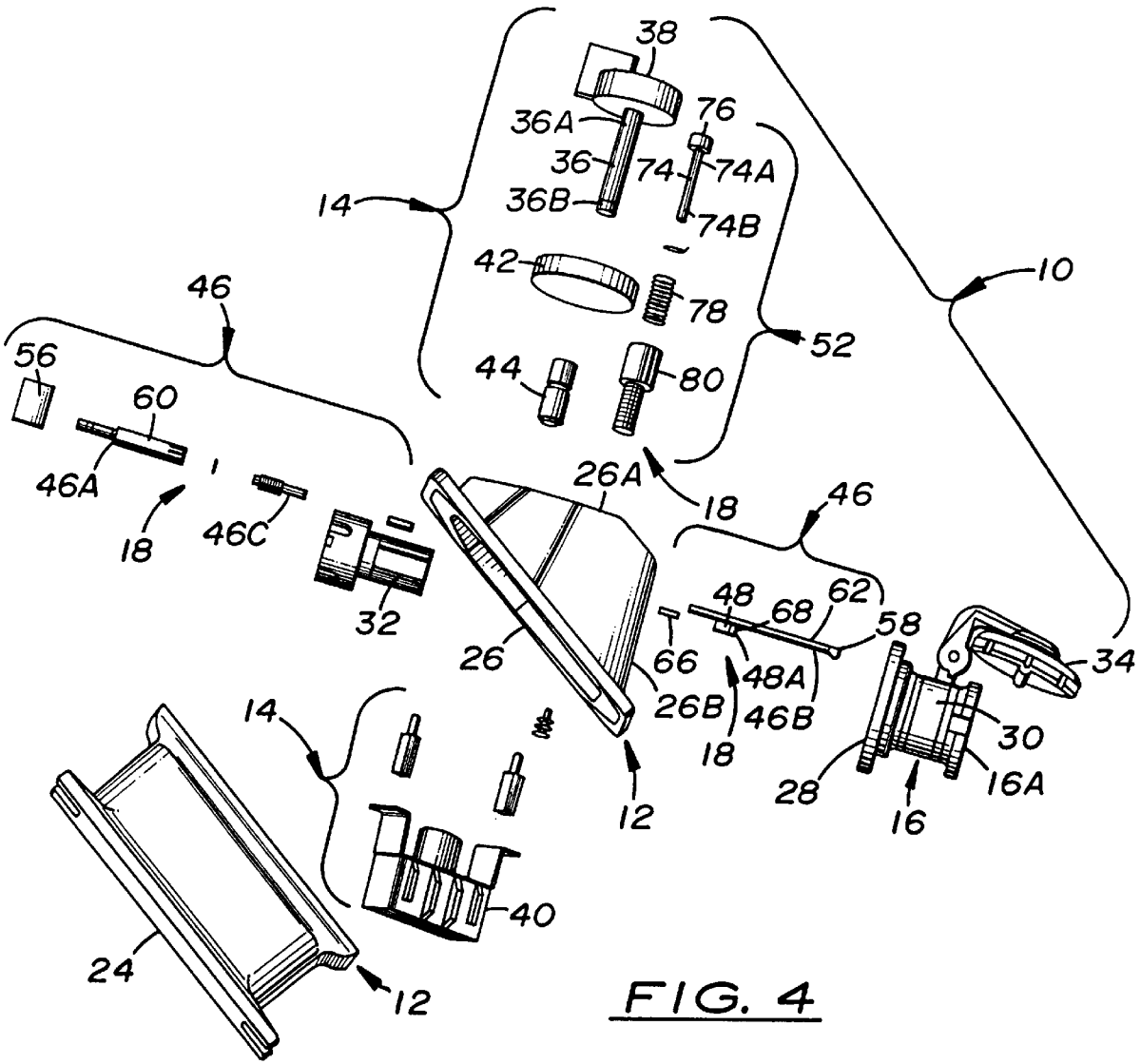
FIG. 4 is an exploded side elevational view of the assembly of FIG. 1.
Figure 16:
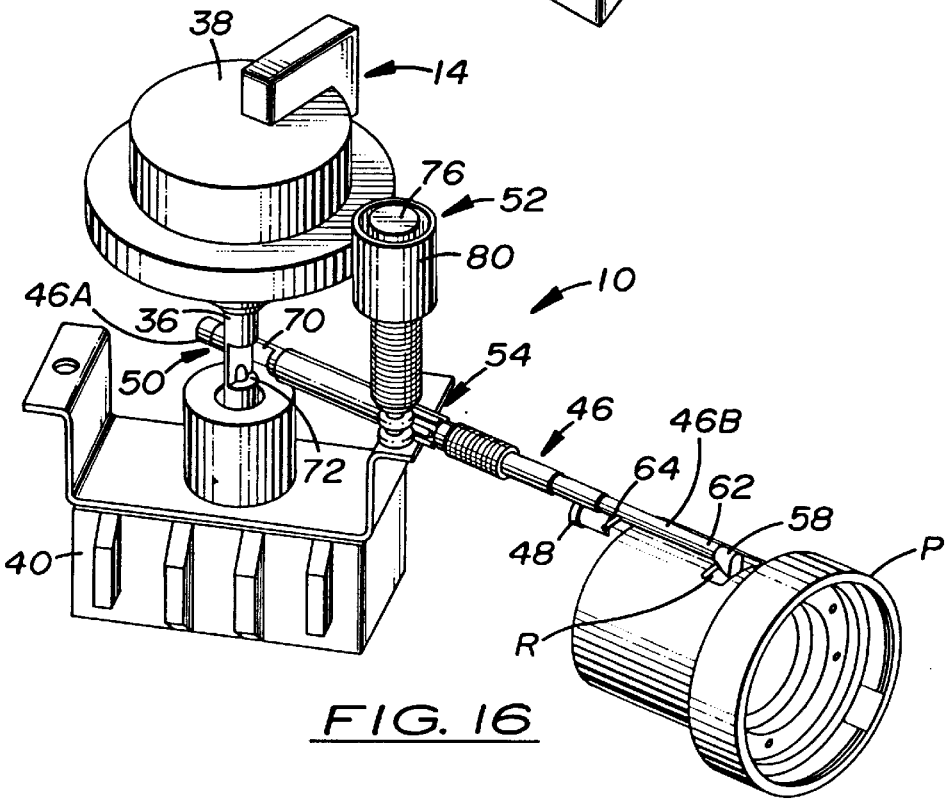
FIG. 16 is an enlarged partial perspective view of the assembly similar to that of FIG. 11 but with the switch mechanism in an ON position.
Figure 17:
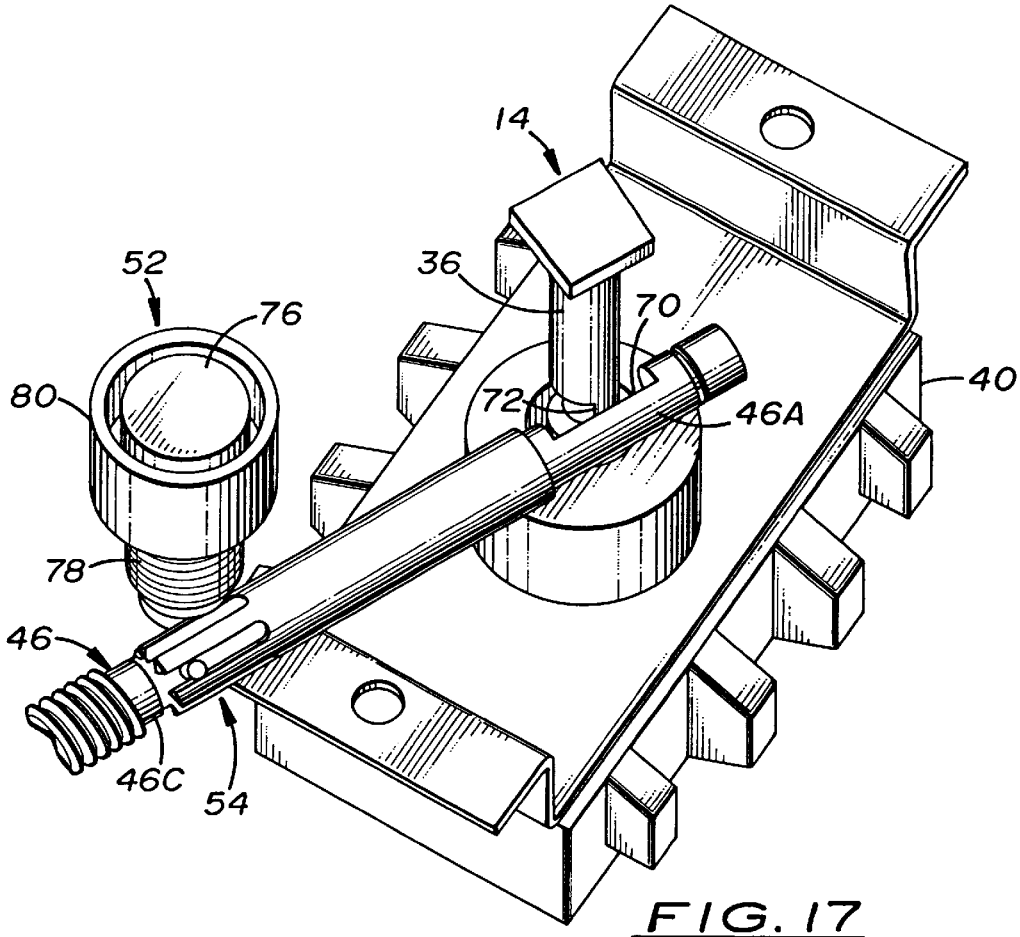
FIG. 17 is an enlarged fragmentary perspective view of the assembly with switch and interlock mechanisms in the same positions as in FIG. 16.

Referring to FIGS. 16 and 17, in the third condition (plug inserted and locked—switch on—release button disabled), when the switch mechanism is moved to the ON position shown in FIG. 2, the recessed section 72 of the switch shaft 36 is rotated away from the interlock shaft 46 such that the switch shaft 36 intrudes into the recessed section 70 of the interlock shaft 46 and prevents it and the pawl 58 from rotating and retains them locked at their respective locked and locking positions. With the interlock shaft 46 thereby locked, the actuating button 76 is disabled since axial movement thereof is prevented. Thus, while the switch mechanism 14 is at the On position, the actuating button 76 cannot be depressed and the plug P cannot be removed from the receptacle body 16.

Figure 18:
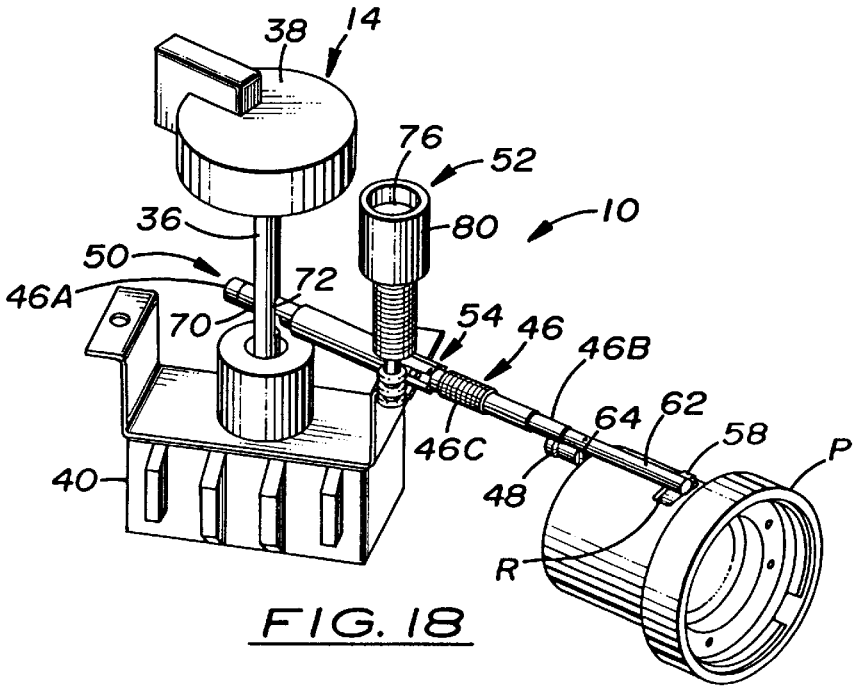
FIG. 18 is an enlarged partial perspective view of the assembly similar to that of FIG. 11 but with the interlock mechanism in an unlocked position relative to the receptacle body of the assembly.

Referring to FIG. 18, in the fourth condition (plug inserted and locked—switch off—release button depressed), provided the switch mechanism 14 is in the OFF position, depressing the actuating button 76 will cause rotation of the interlock shaft 46 via the rack-and-pinion coupling joint 54. With the actuating button 76 fully depressed, the pawl 58 on the interlock shaft 46 is swung out of the plug recess R with rotation of the interlock shaft 46 allowing removal of the plug P. By having the switch mechanism 14 in the OFF position and the actuating button 76 fully depressed is the only way in which the plug P can be withdrawn once inserted into the receptacle body 16, even if the switch mechanism 14 is never moved to the ON position. As the plug P is withdrawn, the spring 66 beneath the catch element 48 moves it through its pilot hole 28A in the receptacle body bottom portion 28 and into the interior cavity 22 of the receptacle body 16 where its tangs 68 again straddle the pin 64 on the interlock shaft 46. In this way, the catch element 48 holds the interlock shaft 46 and its pawl 58 at the withdrawn position so as to allow entry of the plug back into the receptacle body 16 and prevent the switch mechanism 14 from being rotated away from the OFF position. Also, the actuating button 76 is held in its depressed position, storing the spring energy that will be used to rotate the interlock shaft 46 when a plug P is again inserted into the receptacle body 16.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A receptacle assembly, comprising:

(a) a housing having an interior chamber;

(b) a switch mechanism movably mounted to said housing and having a switch shaft having opposite outer and inner portions and being rotatable mounted at said outer portion to said housing and extending into said interior chamber of said housing at said inner portion of said switch shaft, said switch mechanism capable of being moved relative to said housing and switched between OFF and ON positions;

(c) a receptacle body spaced from said switch mechanism and mounted to said housing, said receptacle body having an interior cavity in which a plug can be inserted into said receptacle body; and (d) an internal interlock mechanism supported within said interior chamber of said housing and extending between said interior cavity of said receptacle body and said switch shaft of said switch mechanism extending into said interior chamber of said housing, said interlock mechanism being rotatable between unlocked and locked positions relative to said receptacle body and relative to said switch shaft of said switch mechanism such that said interlock mechanism when in said locked position relative to said receptacle body and concurrently in said unlocked position relative to said switch mechanism prevents removal of a plug from said receptacle body after said switch mechanism has been switched to said ON position whereas said interlock mechanism when in said unlocked position relative to said receptacle body and concurrently in said locked position relative to said switch mechanism prevents switching of said switch mechanism from said OFF position to said ON position once a plug is allowed to be removed from or reinserted into said receptacle body, said interlock mechanism including an elongated interlock shaft having first and second end portions and an intermediate Dortion disposed between said first and second end portions, said interlock shaft being rotatably supported within said interior chamber of said housing and extending at said first end portion to adjacent to said inner portion of said switch shaft and extending at said second end portion into said interior cavity of said receptacle body, said second end portion of said interlock shaft having a pawl thereon protruding laterally therefrom such that rotation of said interlock shaft moves said pawl between withdrawn and locking positions relative to a plug inserted in said interior cavity of said receptacle body.

2. The assembly as recited in claim 1, wherein said housing also has first and second mounting portions being angularly displaced from one another, said switch mechanism being mounted to said first mounting portion of said housing, said receptacle body being mounted to said second mounting portion of said housing.

3. The assembly as recited in claim 1, wherein said switch mechanism includes a knob disposed exteriorly of said housing and attached on said outer portion of said switch shaft, said knob being adapted for gripping by a person in order to rotate said switch shaft and thereby move said switch mechanism between said OFF and ON positions.

4. The assembly as recited in claim 1, wherein said receptacle body has a bottom portion and a sidewall portion attached to and surrounding said bottom portion and extending outwardly therefrom and defining an interior cavity in which the plug can be inserted into said receptacle body to said bottom portion thereof.

5. The assembly as recited in claim 1, wherein said interlock mechanism also includes a catch element disposed adjacent to said second end portion of said interlock shaft and coupled therewith when the plug is removed from said receptacle body such that said interlock shaft is held by said catch element in said unlocked position relative to said receptacle body and in said locked position relative to said switch mechanism.

6. The assembly as recited in claim 5, wherein said catch element is displaced relative to said second end portion of said interlock shaft and decoupled therefrom when the plug is inserted into said receptacle body such that said interlock shaft is released by said catch element and free to move between said unlocked and locked positions relative to said receptacle body and said switch mechanism.

7. The assembly as recited in claim 1, wherein said interlock shaft includes an interface shaft segment and a locking shaft segment disposed in axial alignment and connected end-to-end with one another such that said interface and locking shaft segments rotate together, said interface shaft segment being disposed substantially in said interior chamber of said housing and having said first end portion disposed adjacent to said inner portion of said switch shaft, said locking shaft segment being disposed substantially in said interior cavity of said receptacle body and having said pawl thereon.

8. The assembly as recited in claim 1, wherein said interlock mechanism further includes means for interfacing said first end portion of said interlock shaft and said inner portion of said switch shaft with each other such that rotation of said switch shaft to said OFF and ON positions of said switch mechanism correspondingly allows and prevents rotation of said interlock shaft whereas rotation of said interlock shaft to said unlocked and locked positions relative to said receptacle body and of said pawl to said withdrawn and locking positions relative to a plug in said receptacle body correspondingly prevents rotation of said switch shaft from said OFF position of said switch mechanism and allows rotation of said switch shaft between said OFF and ON positions of said switch mechanism.

9. The assembly as recited in claim 8, wherein said means for interfacing said first end portion of said interlock shaft and said inner portion of said switch shaft with each other includes a recessed section defined in said first end portion of said interlock shaft and a complementary recessed section defined in said inner portion of said switch shaft, said recessed sections being arranged relative to one another such that contact will occur between said switch shaft and interlock shaft when said switch shaft is in said ON position of said switch mechanism, but will not occur between said switch shaft and interlock shaft when said switch shaft is in said OFF position, that will prevent rotation of said interlock shaft from said locked position to said unlocked position relative to said receptacle body.

10. The assembly as recited in claim 8, wherein said interlock mechanism further includes an actuator assembly having an actuating shaft with outer and inner end portions and being mounted to said housing for undergoing reciprocal movement in said interior chamber thereof toward and away from said intermediate portion of said interlock shaft and an actuating button attached on said outer end portion of said actuating shaft and disposed exteriorly of said housing for depressing and releasing said actuating button to move said actuating shaft relative to said interlock shaft.

11. The assembly as recited in claim 10, wherein said interlock mechanism further includes means for movably coupling said intermediate portion of said interlock shaft to said lower end portion of said actuating shaft such that depression and release of said actuating button and shaft correspondingly causes rotation of said interlock shaft in opposite directions, said actuating button and shaft being held at a disabled position when said interlock shaft is in said locked position relative to said receptacle body and said switch mechanism is in said ON position, said actuating button and shaft being released from said disabled position and allowed to be depressed and reciprocally moved to rotate said interlock shaft from said locked position to said unlocked position relative to said receptacle body when said switch mechanism is in said OFF position.

12. The assembly as recited in claim 11, wherein said means for movably coupling said intermediate portion of said interlock shaft to said lower end portion of said actuating shaft is a rack-and-pinion joint on said interlock shaft and said actuating shaft.

13. The assembly as recited in claim 1, wherein said interlock mechanism, with a plug inserted in said receptacle body and in response to switching said switch mechanism to said ON position, is locked relative to said receptacle body preventing removal of the plug from said receptacle body.

14. The assembly as recited in claim 1, wherein said interlock mechanism, with a plug inserted in said receptacle body and said switch mechanism disposed in said OFF position, is actuatable to said unlocked position relative to said receptacle body allowing the plug to be removed from said receptacle body and concurrently therewith is locked relative to said switch mechanism preventing switching of said switch mechanism from said OFF to said ON position.

15. The assembly as recited in claim 1, wherein said interlock mechanism, after the plug is removed from said receptacle body, remains in said locked condition relative to said switch mechanism preventing switching of said switch mechanism to said ON position and concurrently therewith remains in said unlocked condition relative to said receptacle body until a plug is again inserted into said receptacle body.

16. A receptacle assembly, said comprising:

(a) a housing having an interior chamber;

(b) a switch mechanism including (i) a switch shaft having opposite outer and inner portions and being rotatable mounted to said housing and extending into said interior chamber thereof, and (ii) a knob disposed exteriorly of said housing and attached on said outer portion of said switch shaft for gripping to rotate said switch shaft and thereby move said switch mechanism between OFF and ON positions;

(c) a receptacle body mounted to said housing and having a bottom portion and a sidewall portion attached to and surrounding said bottom portion and extending outwardly therefrom and defining an interior cavity in which a plug can be inserted into said receptacle body to said bottom portion thereof; and (d) an interlock mechanism including (i) an elongated interlock shaft having first and second end portions and an intermediate portion disposed between said first and second end portions, said interlock shaft being rotatably supported within said interior chamber of said housing and extending at said first end portion to adjacent to said inner portion of said switch shaft and at said second end portion through said bottom portion of said receptacle body and into said interior cavity of said receptacle body along said sidewall thereof, said second end portion of said interlock shaft having a pawl thereon protruding laterally therefrom such that rotation of said interlock shaft moves said pawl between withdrawn and locking positions relative to a plug when inserted in said interior cavity of said receptacle body, (ii) means for interfacing said first end portion of said interlock shaft with said inner portion of said switch shaft such that rotation of said switch shaft to said OFF and ON positions of said switch mechanism correspondingly allows and prevents rotation of said interlock shaft whereas rotation of said interlock shaft to said unlocked and locked positions relative to said receptacle body correspondingly prevents rotation of said switch shaft from said OFF position of said switch mechanism and allows rotation of said switch shaft between said OFF and ON positions of said switch mechanism, (iii) an actuator assembly having an actuating shaft with outer and inner end portions and being mounted to said first mounting portion of said housing for undergoing reciprocal movement in said interior chamber thereof toward and away from said intermediate portion of said interlock shaft and an actuating button attached on said outer end portion of said actuating shaft and disposed exteriorly of said housing for depressing and releasing said actuating button to move said actuating shaft relative to said interlock shaft, (iv) means for movably coupling said intermediate portion of said interlock shaft to said inner end portion of said actuating shaft such that depression and release of said actuating button and shaft correspondingly causes rotation of said interlock shaft in opposite directions and vice versa, said actuating button and shaft being held at a disabled position when said interlock shaft is at said locked position and said switch mechanism is at said ON position, said actuating button and shaft being released from said disabled position and allowed to be depressed when said interlock shaft is at said unlocked position and said switch mechanism is at said OFF position, and (v) a catch element disposed adjacent to said second end portion of said interlock shaft and coupled therewith when the plug is removed from said receptacle body such that said interlock shaft is held by said catch element in said unlocked position relative to said receptacle body and in said locked position relative to said switch mechanism, said catch element being displaced relative to said second end portion of said interlock shaft and decoupled therefrom when the plug is inserted into said receptacle body such that said interlock shaft is released by said catch element and free to move between said unlocked and locked positions relative to said receptacle body and said switch mechanism, whereby said interlock mechanism, with a plug inserted in said receptacle body and in response to switching said switch mechanism to said ON position, is placed in said unlocked position relative to said switch mechanism allowing switching of said switch mechanism between said ON and OFF positions and concurrently therewith is placed in said locked position relative to said receptacle body preventing removal of the plug from said receptacle body, whereas said interlock mechanism, with a plug inserted in said receptacle body and said switch mechanism disposed in said OFF position, is actuatable to an unlocked position relative to said receptacle body allowing the plug to be removed from said receptacle body and concurrently therewith is placed in said locked position relative to said switch mechanism preventing switching of said switch mechanism from said OFF position to said ON position, said interlock mechanism, after the plug is removed from said receptacle body, remaining in said locked position relative to said switch mechanism preventing switching of said switch mechanism to said ON position and in said unlocked position relative to said receptacle body until a plug is again inserted into said receptacle body.

17. The assembly as recited in claim 16, wherein said housing also has first and second mounting portions being angularly displaced from one another, said switch mechanism being mounted to said first mounting portion of said housing, said receptacle body being mounted to said second mounting portion of said housing.

18. The assembly as recited in claim 16, wherein said interlock shaft includes an interface shaft segment and a locking shaft segment disposed in axial alignment and connected end-to-end with one another such that said interface and locking shaft segments rotate together, said interface shaft segment being disposed substantially in said interior chamber of said housing and having said first end portion disposed adjacent to said inner portion of said switch shaft, said locking shaft segment being disposed substantially in said interior cavity of said receptacle body and having said pawl thereon.

* * * * *